United States Patent [19]

Hottinger et al.

[11] 4,127,055

[45] Nov. 28, 1978

[54] CARTRIDGE FEED SYSTEM FOR AN AUTOMATIC GUN

[75] Inventors: Conrad Hottinger; Bruno Ruppen; Pierré Bohler, all of Zürich; Emil Singenberger, Ennetburgen, all of Switzerland

[73] Assignee: Werkzeugmaschinenfabrik Oerlikon-Bührle AG, Zürich, Switzerland

[21] Appl. No.: 837,727

[22] Filed: Sep. 29, 1977

[30] Foreign Application Priority Data

Nov. 26, 1976 [CH] Switzerland ..... 14904/76

[51] Int. Cl.[2] ..... F41D 9/00

[52] U.S. Cl. ..... 89/33 D; 89/33 SF; 89/33 B

[58] Field of Search ..... 89/33 D, 33 SF, 33 A, 89/33 B

[56] References Cited

U.S. PATENT DOCUMENTS 2,910,917 11/1959 Herlach et al. ..... 89/33 B 3,183,778 5/1965 Stadelmann ..... 89/33 B 3,683,743 8/1972 Stoner ..... 89/33 D

*Primary Examiner*—Stephen C. Bentley

*Attorney, Agent, or Firm*—Werner W. Kleeman

[57] ABSTRACT

A cartridge feed system for an automatic gun comprising a drum magazine possessing a number of chambers, the drum magazine being rotatably mounted about a drum shaft connected with the gun mount and incrementally or step-wise drivable. A first feed device is provided which moves the cartridges out of a respective chamber of the drum magazine and such first feed device is arranged stationarily externally of the drum magazine. A storage is disposed between the drum magazine and the gun and possesses two channels. The storage with the channels is arranged to be displaceable and each channel selectively can be shifted or displaced into a work position and into a rest position for the selective firing of different types of ammunition. A second feed device is provided which moves the cartridges out of the storage and delivers such to the gun, while the drum magazine is further rotated through one indexing step.

5 Claims, 12 Drawing Figures

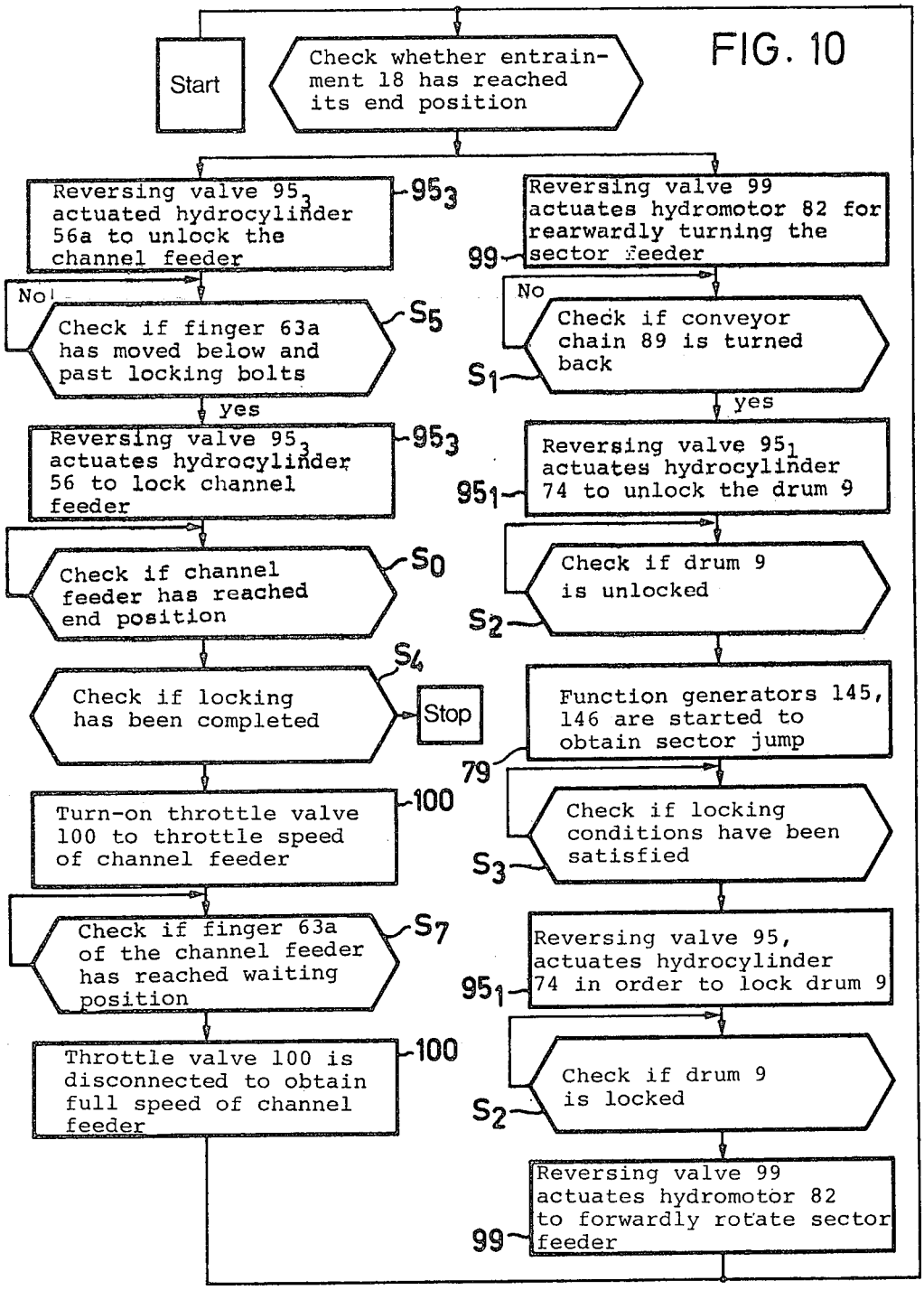
FIG. 10
Start
Check whether entrainment 18 has reached its end position
Reversing valve 95₃ actuated hydrocylinder 56a to unlock the channel feeder
95₃
Reversing valve 99 actuates hydromotor 82 for rearwardly turning the sector feeder
99
No
Check if finger 63a has moved below and past locking bolts
S5
Check if conveyor chain 89 is turned back
S1
yes
Reversing valve 95₃ actuates hydrocylinder 56 to lock channel feeder
95₃
Reversing valve 95₁ actuates hydrocylinder 74 to unlock the drum 9
95₁
Check if channel feeder has reached end position
S0
Check if drum 9 is unlocked
S2
Check if locking has been completed
S4
Stop
Function generators 145, 146 are started to obtain sector jump
79
Turn-on throttle valve 100 to throttle speed of channel feeder
100
Check if locking conditions have been satisfied
S3
Check if finger 63a of the channel feeder has reached waiting position
S7
Reversing valve 95, actuates hydrocylinder 74 in order to lock drum 9
95₁
Throttle valve 100 is disconnected to obtain full speed of channel feeder
100
Check if drum 9 is locked
S2
Reversing valve 99 actuates hydromotor 82 to forwardly rotate sector feeder
99

CARTRIDGE FEED SYSTEM FOR AN AUTOMATIC GUN

BACKGROUND OF THE INVENTION

The present invention relates to a new and improved construction of a cartridge feed system for an automatic gun, which is of the type comprising a gun magazine or drum possessing a number of chambers, the drum magazine being mounted to be rotatable about a drum shaft secured to the gun mount and indexably or step-wise driven, and further includes a first feed device which moves the cartridges in each case out of one of the chambers of the drum magazine, such feed device being arranged stationarily externally of the drum magazine.

With a prior art cartridge feed system of this general type, as disclosed in U.S. Pat. No. 3,683,743, the drum magazine is arranged extremely close to the automatic gun and it is not possible to fire without interruption more cartridges than are contained in a chamber, since each time when the drum is rotated through one switching or indexing step for the purpose of bringing the next successive chamber into its work position, there arises an interruption in the feed of the ammunition to the gun or weapon. Since there can only be stacked a limited number of cartridges in the individual chambers, the aforementioned state-of-the-art system is associated with the drawback that there cannot be carried out any long series of firing operations. When employing the automatic gun as an anti-aircraft weapon there are however required long firing series in order to obtain a high hit efficiency of the aircraft.

SUMMARY OF THE INVENTION

Hence, with the foregoing in mind it is a primary object of the present invention to provide an improved construction of cartridge feed system for an automatic gun which is not associated with the aforementioned drawbacks and limitations of the prior art proposal discussed above.

Still another significant object of the present invention aims at solving the disadvantages of the prior art cartridge feed system and improving the same in such a manner that ammunition can be conveyed to the gun for a random long firing series.

Another significant object of this invention aims at providing a cartridge feed system which enables selectively feeding different types of ammunition.

Another important object of the present invention aims at the provision of a new and improved construction of cartridge feed system for an automatic gun, which allows for increased firing of ammunition from the gun by providing a greater feed of ammunition to the gun, enables selective firing of different types of ammunition to adapt the gun to the encountered target in the most efficacious manner, and which cartridge feed system is relatively simple in construction and design, extremely reliable in operation, not readily subject to breakdown and jamming, and requires a minimum of maintenance and servicing.

Now in order to implement these and still further objects of the invention, which will become more readily apparent as the description proceeds, the cartridge feed system of this development is manifested by the features that there is provided:

(a) a storage which is arranged between the drum magazine or drum and the automatic gun and possesses two channels, the storage together with the channels being arranged to be displaceable and each channel can be selectively brought into a work postion and into a rest position for the selective firing of different types of ammunition; and (b) a second feed device which moves the cartridges out of the storage and delivers them to the gun, while the drum magazine is further rotated through one indexing step.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 10 is a flow diagram for illustrating the course of the process during continuous firing;

DETAILED DESCRIPTION OF THE PREFERRED EMBODIMENTS

Figure 1:
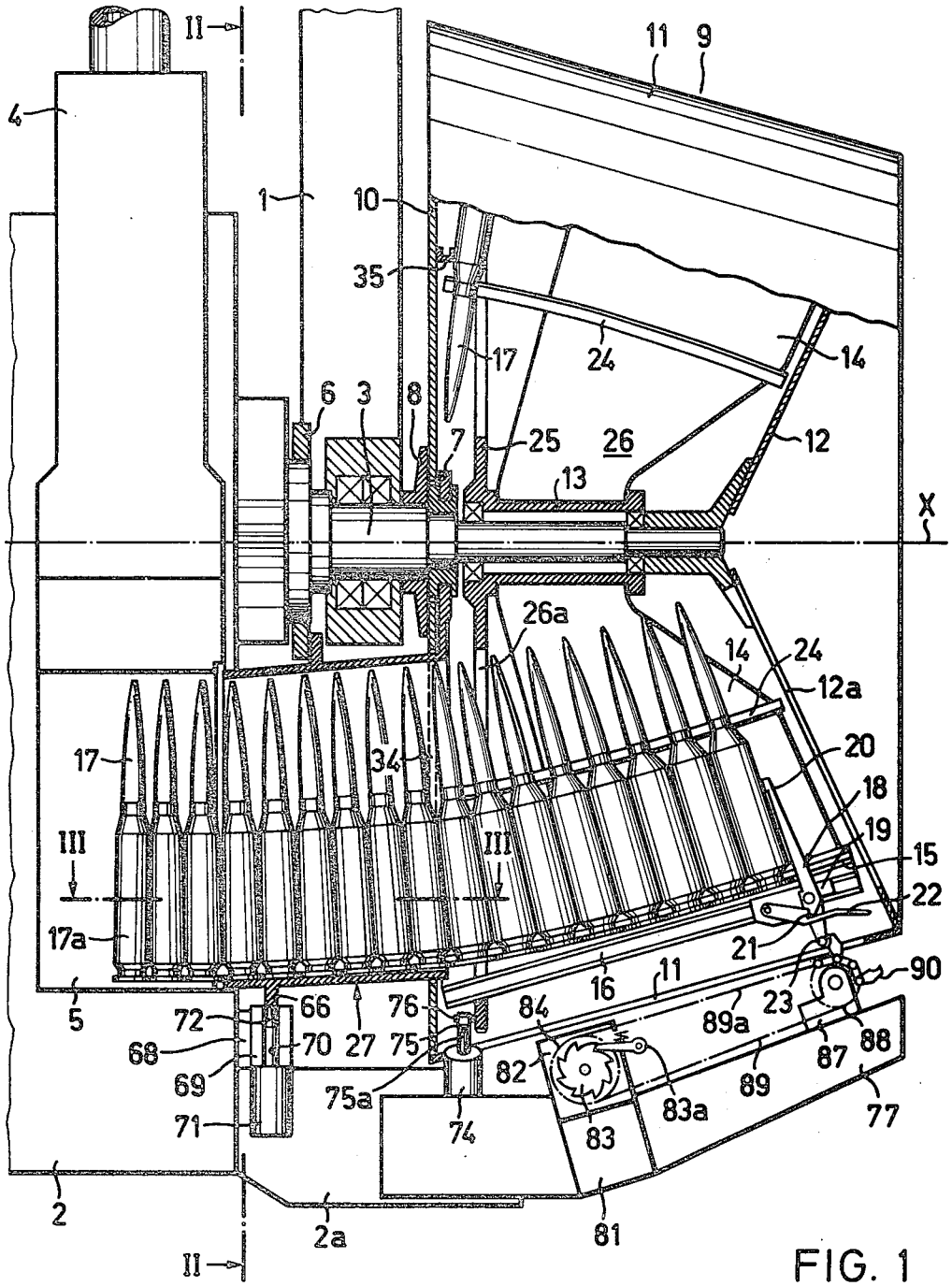
FIG. 1 is a section through a cartridge feed system together with the drum magazine or drum, the section being taken parallel to the lengthwise axis of the weapon or gun barrel.

Describing now the drawings, according to the showing of FIG. 1 two automatic guns or firing weapons 4 are arranged for recoil movement upon a gun mount 2, and in order to simplify the illustration only one of the firing weapons or automatic guns 4 has been shown. Since both automatic guns 4 together with their cartridge feed systems are constructed exactly the same, it is unneccessary to illustrate both guns 4. At the gun mount 2 there are rigidly connected two trunnions 3, wherein in FIG. 1 only one is visible. These trunnions 3 are rotatably mounted in two shields or end covers 1. FIG. 1 illustrates only part of one of the shields 1 which is attached to a not further illustrated platform which is rotatable about an azimuth axis. The gun mount 2 together with the automatic guns 4 are pivotably mounted by means of the trunnions 3 about an elevational sighting axis X in such a manner that the gun 4 can be elevationally positionally adjusted in conventional manner. Secured to the gun mount 2 is a cartridge feed system 5 which does not move during the recoil motion of the gun 4.

A drum housing 9 is rigidly secured to the trunnions 3, this drum housing 9 entrainably moving along during the elevational adjustment of the automatic gun 4. This drum housing 9 is formed by a disk-shaped end wall 10, a truncated conically-shaped shell or casing 11 and a conically-shaped end wall 12. Internally of this drum housing 9 there is rotatably mounted a hub 13 upon the trunnions 3. As best seen by referring to FIG. 2, radial partition walls 14 are secured to the hub 13. These partition walls 14 are arranged at the periphery of the hub 13 at a uniform spacing from one another and in the embodiment under discussion form, for instance, 25 chambers 26. In each chamber 26 there are located for instance eight cartridges 17 arranged in a row, so that with the embodiment under discussion such drum magazine or drum can store two hundred cartridges.

Figure 2:
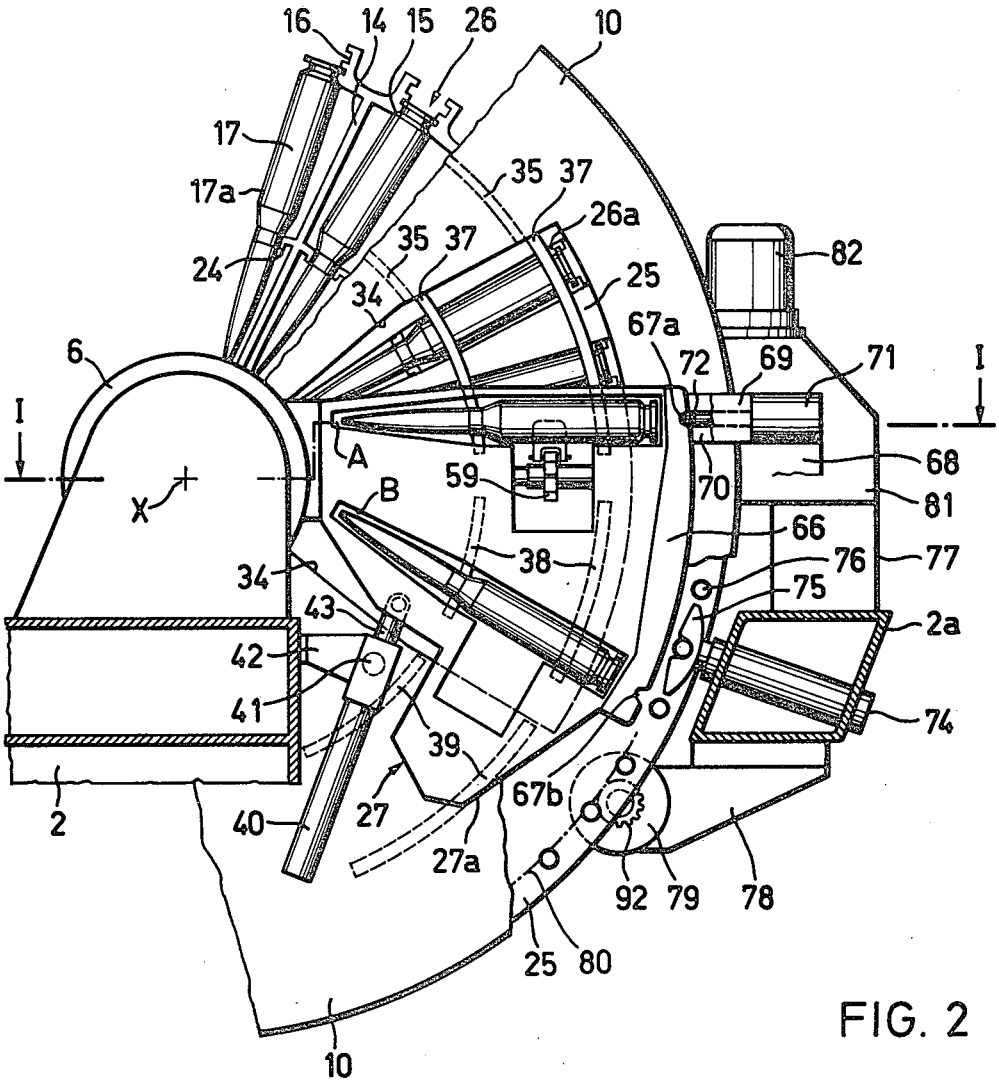
FIG. 2 is a cross-sectional view of the arrangement shown in FIG. 1, taken substantially along the line II—II thereof.

According to the showing of FIG. 2 there are secured guide rails 15 at both sides of the partition walls 14. Between each two neighboring guide rails 15 the cartridges 17 are displaceably guided in conventional manner in the feed direction. Further guide rails 16 are attached to both sides of the partition walls 14. Between each two of such guide rails 16 there is displaceably guided an entrainment member 18 in the feed direction, as also best seen by referring to FIG. 1.

Figure 8:
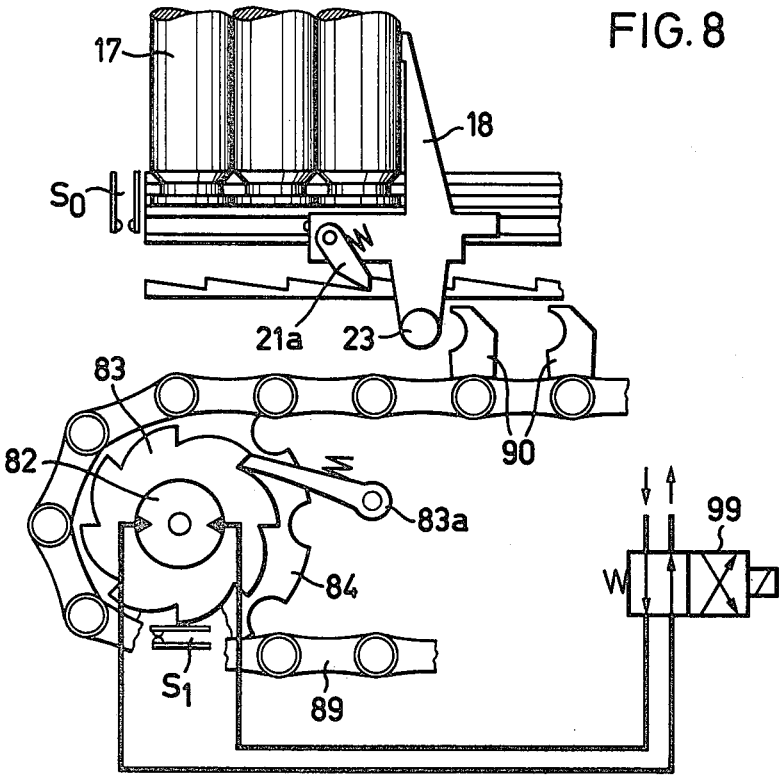
FIG. 8 is a schematic illustration of the control of the first feed device in the drum.

According to the showing of FIG. 1 the entrainment member 18 possesses a carriage 19 which is guided between two neighboring rails 16 and at which there is hingedly connected a pivotable arm or arm member 20. In the illustrated position the arm 20 protrudes into the related chamber 26 and bears against the rearmost cartridge 17 located therein. By means of a lever 22, possessing a stop or impact member 21, the arm 20 is retained in the illustrated position. This lever 22 is likewise pivotably mounted at the carriage 19 of the entrainment member 18. In order to displace the entrainment member 18 located in the drum housing 9 in the guide rails 16 there is attached to a protruding portion or part of the carriage 19 a roller or roll 23 which comes into engagement with the entrainment teeth 90 of an endless chain 89 located externally of the drum housing 9 and as will be discussed more fully hereinafter. As shown in FIG. 8, a pawl 21*a* prevents any rearward movement of the carriage 19. A not particularly illustrated carriage retrieval device renders it possible to disengage the pawl 21*a* and to shift the carriage 19 back into its starting position, in order that the chamber 26 can be filled or emptied as the case may be. Only the carriage 19 which is momentarily located in the loading position can be shifted back by means of the carriage retrieval or return device. When the endless chain 89 which is located externally of the drum housing 9 is driven, then it displaces the entrainment member 19 along the guide rails 16 and the arm or arm member 20 pushes the cartridges 17 which are guided in the guide rails 15 out of the chamber 26 of the drum magazine or drum 9. The cartridge sleeves 17*a* of the cartridges 17 are guided by two respective further guide rails 24 (FIG. 2) which likewise are attached to both sides of the partition walls 14.

These partition walls 14 are connected through the intermediary of the guide rails 15 and 16 at a disk-shaped plate 25 (FIG. 1) arranged adjacent to the end wall 10, such plate 25 possessing for each chamber 26 an outlet or discharge opening 26*a*, as best seen by referring to FIG. 2. Plate 25 is likewise secured to the hub 13 (FIG. 1).

In order that the cartridges 17 located in the drum magazine or drum 9 can arrive at the firing weapon or gun 4, the invention contemplates providing between the automatic gun 4 and the drum magazine or drum 9 which is arranged in spaced relationship from the gun 4 a pivotable intermediate channel which forms a storage 27 which will be described in greater detail in conjunction with the showing of FIG. 3. This storage 27 possesses a pivotable housing 27*a* in which there are arranged two channels A and B. These channels A and B possess an inlet opening 28 through which the cartridges 17 can move out of the drum magazine or drum 9 into the storage 27 as well as an outlet or exit opening 29 by means of which the cartridges 17 can move out of the storage 27 into the cartridge feed system 5 of the automatic gun. The first half of the guide surfaces of both channels A and B is inclined with regard to the second half of the guide surfaces through an angle of about 30°. Both of the channels A and B are arranged in spaced relationship in the housing of the storage 27. The walls of both channels A and B are attached to two mutually parallel walls 30 and 30*a* of the storage 27 and protrude by means of the projections 31 past the rear wall 30. The housing of the storage 27, according to the showing in FIG. 1, will be seen to possess two rings or ring members 6 and 7, by means of which the storage 27 is pivotably hinged to the trunnions 3. This storage 27 extends through an opening 34 of the end wall 10 into the interior of the drum magazine or drum 9. This opening 34 must be greater than the housing of the storage 27, so that such can pivot to such an extent that either the one or the other of both channels A and B is in alignment with the ammunition feed system 5 of the automatic gun 4, i.e. the intermediate channel 27 must be pivotable through an angle of about 30°.

In order to prevent unintentional dropping of the cartridges 17 out of the chambers 26 of the drum or drum magazine 9, and as best seen by referring to FIG. 2, two arc-shaped or circular bent rails 35 are attached to the inner wall or inside of the end wall 10, but such rails allow for the passage of the cartridges 17 through the opening 34 of the end wall 10. The cartridges 17 can slide along these rails 35 from each chamber 26 which is closest to the end wall 10.

In order to prevent unintentional dropping out of the cartridges 17 through the opening 34, without reaching one of the channels A and B, there are secured to the housing of the storage 27 likewise circular-shaped bent or arc-shaped rails 37, 38 and 39. These rails 37, 38 and 39 are interrupted at the region of the channels A and B and are arranged concentrically with regard to the rails 35 of the drum magazine or drum 9, as best seen by referring to FIG. 2.

Now in order to rock the storage 27 a cylinder 40 is pivotably mounted by means of the pin 41 upon a support or carrier 42 of the gun mount 2. Within this cylinder 40 there is located a piston which is hingedly connected by means of a piston rod 43 with the housing of the intermediate channel.

Figure 4:
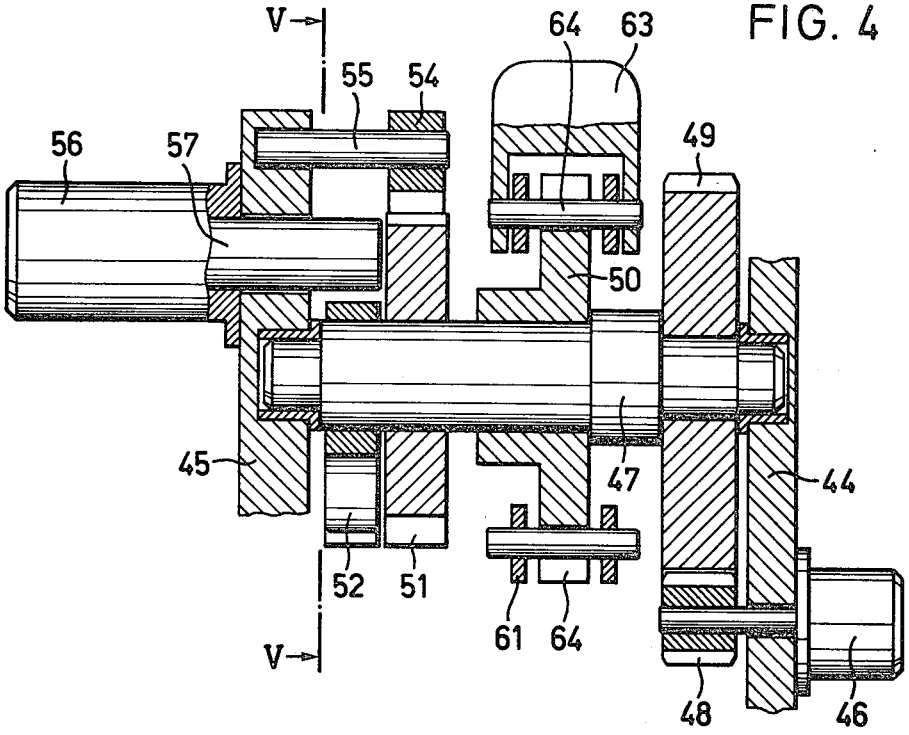
FIG. 4 is a cross-sectional view taken substantially along the line IV—IV of FIG. 3.

Now as best seen by referring to FIG. 4, in order to feed the cartridges 17 into the channels A and B of the storage 27 there are secured to a respective wall of both channels A and B two respective transverse walls 44 and 45 which extend in parallelism to one another. Between both of these transverse walls 44 and 45 there is arranged a feed device for each channel A and B. Since both of the feed devices are of the exact same construction, it will suffice to consider in the following description only the feed device for the channel A.

Figure 3:
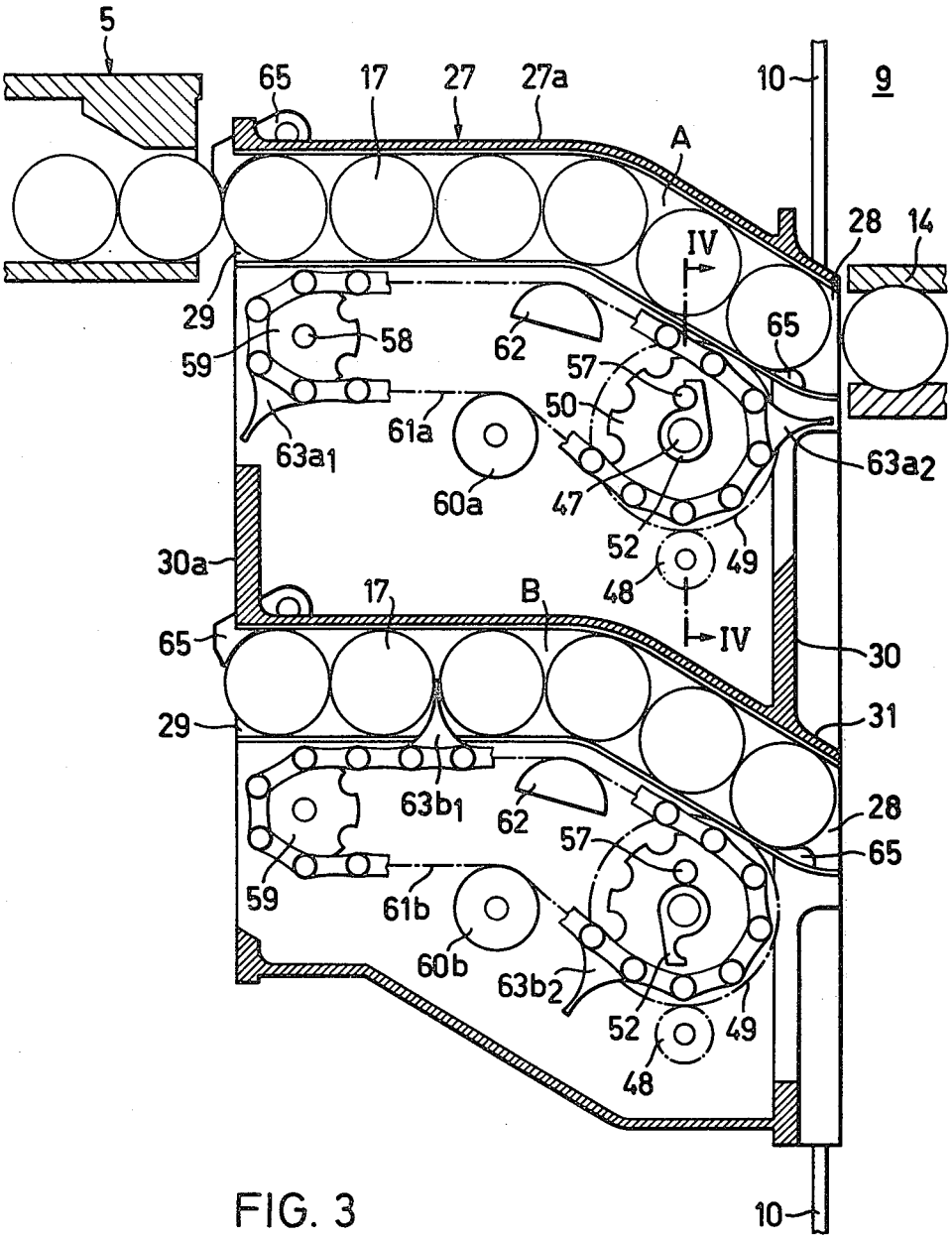
FIG. 3 is a cross-sectional view through an intermediate channel serving as a storage, the sectional view being taken substantially along the line III—III of FIG. 1.

As evident from the showing of FIG. 3, this feed device possesses two shafts 47 and 58 which extend in parallelism to one another and are mounted at both walls 44 and 45. The shaft 47 carries a sprocket wheel 50, a gear 49, and a ratchet wheel 51 having a stop or impact member 52, as best observed from the illustration of FIG. 4. As will be seen from FIGS. 2 and 3, the shaft 58 only carries a sprocket wheel 59 or equivalent structure. By means of both sprocket wheels 50 and 59 there is tensioned an endless conveyor chain 61. The gear 49 meshes with a pinion 48, as shown in FIG. 4, the pinion 48 being secured to the shaft of a hydromotor 46 which, in turn, is arranged at the transverse wall 44. A pair of deflecting wheels or gears 60 serves to tension the conveyor chain 61. This conveyor or feed chain 61 is furthermore guided over a tensioning device 62. The endless conveyor chain 61 possesses two entrainment teeth $63a_1$ and $63a_2$ which exactly bisect the periphery of the chain, by means of which there are engaged the cartridges 17 and further conveyed in the channel A.

Figure 5:
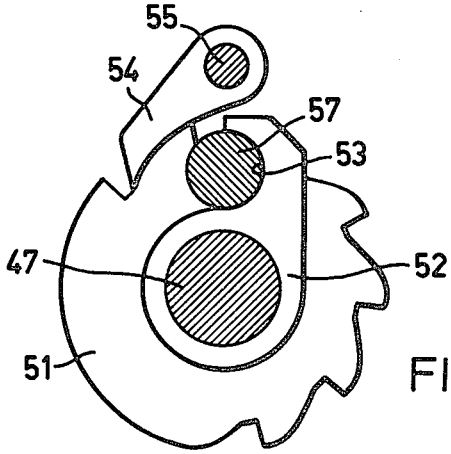
FIG. 5 is a cross-sectional view taken substantially along the line V—V of FIG. 4.

Continuing, and as will be apparent from FIG. 3, the channels A and B each accommodate six cartridges 17, and accordingly there are provided at the aforementioned ratchet wheel 51 six ratchet teeth (FIG. 5) with which there engages a pawl 54 which is pivotably mounted at the wall 45. Furthermore, as shown in FIG. 4, a cylinder 56 is secured to the wall 45 and contains a not particularly referenced piston having a piston rod 57. This piston rod 57 cooperates with the stop or impact member 52 provided at the ratchet wheel 51 and ensures that after ejection of six cartridges by the one entrainment tooth $63a_2$ the other entrainment tooth $63a_1$ will arrive in the correct waiting or preparatory position, as shown in FIG. 3, in order to be able to thereafter feed the next six cartridges. In the preparatory position the entrainment tooth $63a_2$ is located directly prior to engagement with the intermediate channel, without however protruding into such intermediate channel.

Retaining pawls 65 are pivotably mounted both at the outlet or exit opening 29 as well as also at the inlet opening 28, these retaining pawls preventing re-entry of the cartridges 17 out of the ammunition feed system 5 into the storage 27 and out of the storage 27 back into the drum magazine or drum 9.

According to the showing of FIGS. 1 and 2 a flange 66 is secured at the housing of the storage 27 in order to be able to fixedly retain the pivotable storage 27 in the correct position. This flange 66 possesses two cut-outs or recessess 67*a* and 67*b* which are associated with both of the channels A and B. Additionally, a support or carrier 68 is secured to the gun mount 2 and at which there is arranged a cylinder 71 containing a spring-loaded piston with a piston rod which forms a locking bolt 72 which either protrudes into the one or other recess 67*a* and 67*b*, in order to fix the storage 27 in the desired position. The support or carrier 68 furthermore possesses a head 69 having a groove 70 in which there is guided the flange 66 with the recesses 67*a* and 67*b*. As best seen by referring to FIG. 2, the locking bolt 72 engages into the recess 67*a* and ensures that the channel A is located in its work or working position.

In order to be able to fix each of the 25 chambers 26 exactly in front of the respective channels A and B, as the case may be, which is rotated in its work or working position, there are attached at the entire periphery of the previously described disk-shaped plate 25 the bolts 76 wherein each bolt 76 is associated with a chamber 26. Additionally, there is attached to an overhang arm 2*a* of the gun mount 2 a cylinder 74 containing a piston having a piston rod 75*a*. At a head 75 of the piston rod 75*a* (FIG. 1) there is provided a recess or cut-out in which in each instance there can be fixed a bolt 76 of the plate 25.

Now in order to rotate the drum magazine or drum 9 there is arranged upon the plate 25 a toothed rim 80, as best seen by referring to FIG. 2. Furthermore, a support 78 (FIG. 2) is secured to the aforementioned overhang arm 2*a* of the gun mount 2 and a hydromotor 79 is arranged upon such support or carrier 78. The shaft of this hydromotor 79 carries a pinion 92 which meshes with the toothed rim 80.

In order to feed the cartridges 17 out of the drum magazine or drum 9 there is provided a further feed device. As shown in FIGS. 1 and 2, such is located upon an arm 77 which possesses a box-like cross-sectional configuration and this arm 77 carries an upright or stand 81. Upon the upright or stand 81 there is attached the hydromotor 82, the shaft of which carries a ratchet wheel 83 and a sprocket wheel 84. Further, a support or carrier 87 is secured to the arm 77, and upon the support or carrier 87 there is rotatably mounted a second sprocket wheel 88. By means of both sprocket wheels 84 and 88 there can be tensioned an endless conveyor chain 89 or equivalent structure.

The ratchet wheel 83 (FIG. 8) secured to the sprocket wheel 84 and equipped with six ratchet teeth and a stationarily mounted pawl lever 83*a* prevents return movement of the conveyor chain 89. In the event that the hydromotor 82 driving the conveyor chain 89 is rotated back, then the conveyor chain 89 can only be moved back to an extent that some play prevails between the entrainment tooth 90 and the roller or roll 23. The division of the ratchet wheel 83, i.e. the spacing or pitch between the ratchet teeth corresponds to the spacing of the cartridges 17 from one another. In this way there is avoided that during rotation of the drum 9 the entrainment teeth 90 will impact against the roller 23. The endless conveyor chain 89 possesses a number of entrainment teeth 90 arranged at a uniform spacing from one another. These entrainment teeth 90 extend through the casing or shell 11 into the interior of the drum magazine or drum 9, during such time as the chain run 89*a* moves along the drum magazine or drum 9. These entrainment teeth 90 impact against the roller 23 of the entrainment member 18 of the chamber 26 located in its work or working position and displace such downwardly into the guide rails 16.

Figure 6:
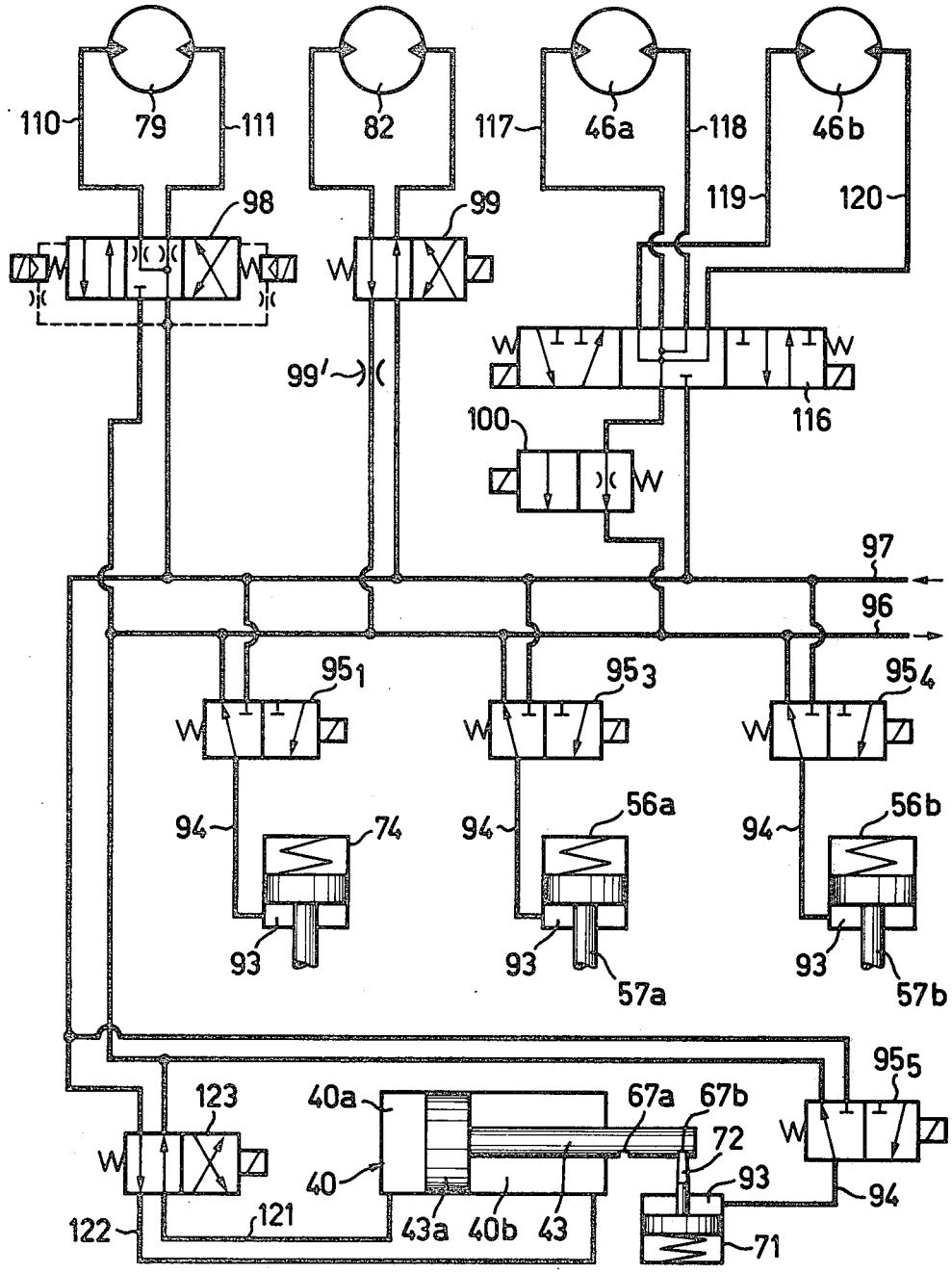
FIG. 6 is a schematic illustration of the hydraulic installation employed in the arrangement of FIG. 1.

The control of the previously discussed hydromotors and cylinder will be apparent from the schematic showing of the hydraulic installation portrayed in FIG. 6.

In this schematic diagram there are illustrated schematically the following hydromotors:

1. Hydromotor 79, which by means of the pinion 92 and the toothed rim 80 rotates the drum magazine 9.

2. Hydromotor 82, which drives the endless conveyor chain 89, by means of which the cartridges 17 are conveyed out of the chambers 26 of the drum magazine or drum 9.

3. Two hydromotors 46*a* and 46*b* which drive the endless conveyor chains 61 by means of which the cartridges 17 in the intermediate channel 27 are conveyed out of the channels A and B.

Further, in the schematic diagram of FIG. 6 there are schematically illustrated the following cylinders:

1. Cylinder 40, the piston 43*a* of which places the channel A or the channel B of the storage 27 in its work position.

2. Two cylinders 56*a* and 56*b*, respectively, the pistons of which lock both of the endless conveyor chains 61 of the storage 27 in the desired position.

3. Cylinder 71, the piston of which locks the storage 27 in the desired position.

4. Cylinder 74, the piston of which locks the drum magazine or drum 9 in the desired position.

Since the pistions of each of the cylinders 56*a*, 56*b*, 71 and 74 are all spring-loaded, in each case only one cylinder compartment or chamber 93 is connected through the agency of a respective conduit or line 94 with the reversing valves $95_1$, $95_3$, $95_4$, $95_5$. These reversing valves $95_1$, $95_3$, $95_4$, $95_5$ are connected, on the one hand, with a pressure line or conduit 97 and, on the other hand, with a return line or conduit 96 and can be electrically actuated in conventional manner by means of a magnet or equivalent structure. With energized reversing valve $95_1$ pressurized oil is delivered out of a suitable source of pressurized oil via the line or conduit 97 into the cylinder chamber of compartment. On the other hand, when the reversing valve $95_1$ is not energized, then, the pressurized oil, due to the spring pressure, flows back out of the chamber 93 by means of the return line 96 into a not particularly illustrated tank.

Figure 7:
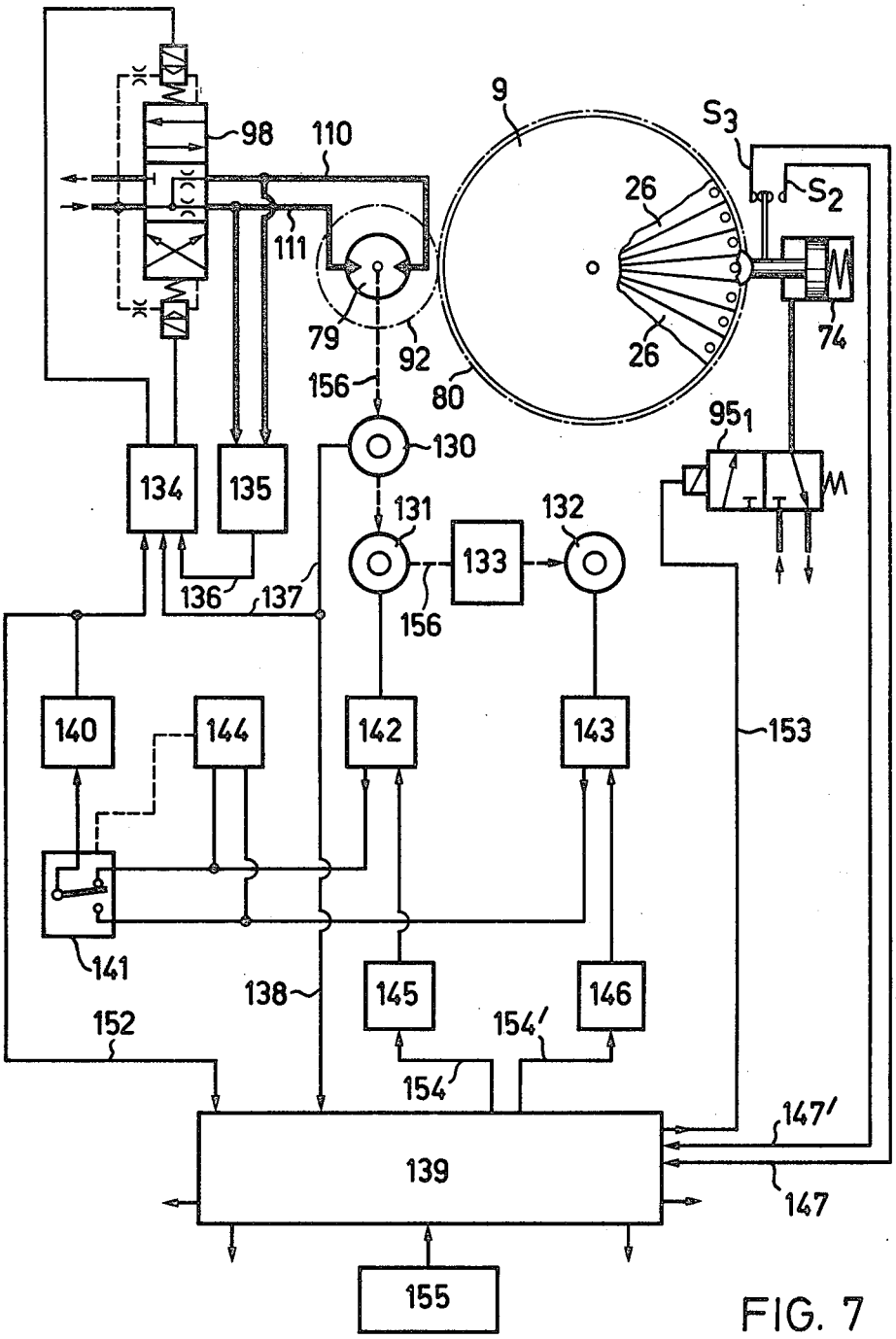
FIG. 7 is a schematic illustration of the electrical control of the drum drive and used in the arrangement of FIG. 1.

As best seen by referring to FIG. 7, the hdyromotor 79 is connected by means of the conduits or lines 110 and 111 with a two-stage electrically controlled servovalve 98, which likewise is connected with the supply line 97 and the return line 96. The hydromotor 82 can be rotated in both directions by means of the reversing valve 99 and the throttle 99'.

Both of the hydromotors 46*a* and 46*b* are connected by means of four lines or conduits 117, 118 and 119, 120 with a reversing valve 116. This reversing valve 116 is likewise connected to the supply line or conduit 97 and the return line or conduit 96. This reversing valve 116 possesses three positions. In the intermediate position both of the hydromotors 46*a* and 46*b* are pressureless and short-circuited, in the one end or terminal position the one hydromotor 46*a* is under pressure and in the other terminal position the other hydromotor 46*b* is under pressure. In order that these hydromotors 46*a* and 46*b* can be driven at two different speeds, there is arranged in the return line 96 a valve 100 forwardly of the reversing valve 116, which valve 100 in one switched position renders possible a large throughflow and in the other switched position a small throughflow.

The cylinder 40 possesses two cylinder chambers or compartments 40*a* and 40*b* which are connected by means of the lines or conduits 121 and 122 with a reversing valve 123. This reversing valve 123, in turn, is connected with the supply line or conduit 97 and the return line or conduit 96. This reversing valve 123 possesses two positions. In the one position the chamber 40*a* is connected with a supply line 97 and the chamber 40*b* with the return line 96, whereas in the other position these connections are interchanged, so that the piston in the cylinder 40 can be moved in both directions as will be evident from the aforegoing disclosure.

According to the showing of FIG. 7, the drum 9 is driven by pinion 92 by means of the hydromotor 79, this pinion 92 being rigidly connected with the hydromotor 79 through the agency of a shaft 156. This pinion 92 meshes with the toothed rim 80 of the drum 9. The number of teeth possessed by the toothed rim 80 and the pinion 92 are chosen such that during one revolution of the drum 9 the pinion 92 rotates 25 times, i.e. during a complete revolution of the pinion 92 the drum 9 is further rotated or indexed by one chamber 26. Now in order to lock the drum 9 in position there is utilized the hydrocylinder 74 which has already been illustrated in FIG. 1 and described in detail heretofore. This hydrocylinder 74 is connected with a control valve 95, which is connected by means of an electrical line 153 with a process computer 139. As will be discussed more fully hereinafter, this process computer 139 ensures that the locking of the drum 9 only then is accomplished upon reaching a desired position of the position feeler of the drum and also when its rotational speed does not exceed a predetermined value. By means of the switches $S_2$ and $S_3$ as well as by means of the lines 147 and 147' signals are delivered to the process computer 139 whenever the drum 9 is unlocked or locked by the hydrocylinder 74.

The shaft 156 drives a tachogenerator 130, a first synchro transmitter "fine" 131 and a second synchro transmitter "course" 132. The second synchro transmitter "course" 132 is connected by means of a control transmission or gearing 133 with the shaft 156, which likewise possesses a step-down or speed reduction ratio of 1:25 in such a manner that the synchro transmitter "course" 132 rotates at the same speed as the drum 9. The hydromotor 79 is connected by means of two hydraulic lines or conduits 110 and 111 with the servovalve 98 which is also illustrated in FIG. 6.

The servovalve 98 is controlled by means of a servo-amplifier 134. The pressure differential in both of the lines 110 and 111 between the servovalve 98 and the hydromotor 79 is measured by a pressure differential transmitter 135. This pressure difference is fed back by means of a line 136 in the form of an electrical signal to the servo-amplifier 134.

The signal of the tachogenerator 130 which indicates the rotational speed of the hydromotor 79 in the form of an electrical signal is also fed back to the servo-amplifier 134. Additionally, the tachgenerator 130 is connected via a line 138 with the process computer 139, so that the rotational speed of the hydromotor 79 is also indicated at the process computer 139. Both of the signal transmitters 131 and 132 are connected with two control transformers 142 and 143, which, in turn, are connected with a respective function generator 145 and 146. These function generators 145 and 146 deliver a reference value regarding the position of the drum 9. This reference value is compared in the control transformers 142 and 143 with the actual value which is generated by both of the synchro transmitters 131 and 132. A signal is produced in the control transformers 142 and 143 due to the comparison of the reference value and the actual value. This signal arrives by means of the switching element 141 and a demodulator filter device 140 at the servo-amplifier 134. This signal is also delivered to the process computer 139 by means of the line or conductor 152.

The drum drive is constituted by a drive means regulated in its position and comprising the synchro transmitters 131 and 132 as the measurement value-converters, the control transformers 142 and 143 as the reference value-actual value comparators, the servo-amplifier 134 as the regulator, the servovalve 98 as the adjustment or setting element and the hydromotor 79 and the drum as the regulation path.

Both of the function generators 145 and 146 are also connected by means of the lines or conductors 154 and 154' with the process computer 139. Furthermore, a control console 155 is connected with the process computer 139. Finally, as indicated in FIG. 7, the process computer 139 controls still other elements.

According to the showing of FIG. 8 the hydromotor 82 of a sector feed or conveyor is controlled by means of the reversing valve 99. This hydromotor 82 drives through the agency of the sprocket wheel 84 the endless conveyor chain 89 which possesses a number of entrainment teeth 90. These entrainment teeth 90 can displace the entrainment member 18 of the sector located in the feed position. This entrainment member 18, in turn, can push the cartridges 17 out of the sector. The end or terminal position of the entrainment member 18, i.e. its position after the ejection of the last cartridge out of the corresponding sector is scanned or sampled by a switch $S_o$ and reported to the process computer 139. During further rotation of the drum 9, in order to bring the next sector in the feed position, there must be eliminated the danger that the entrainment teeth 90 will collide with the roller 23 of the entrainment member 18. For this purpose and prior to rotation of the drum 9, the conveyor chain 89 is rotated back somewhat, in that the valve 99 is switched. This rearward rotation of the conveyor chain 89 is limited by a ratchet wheel 83 and a pawl 83*a*. This operation is sampled or sensed by a switch $S_1$ and reported to the process computer 139.

Figure 9:
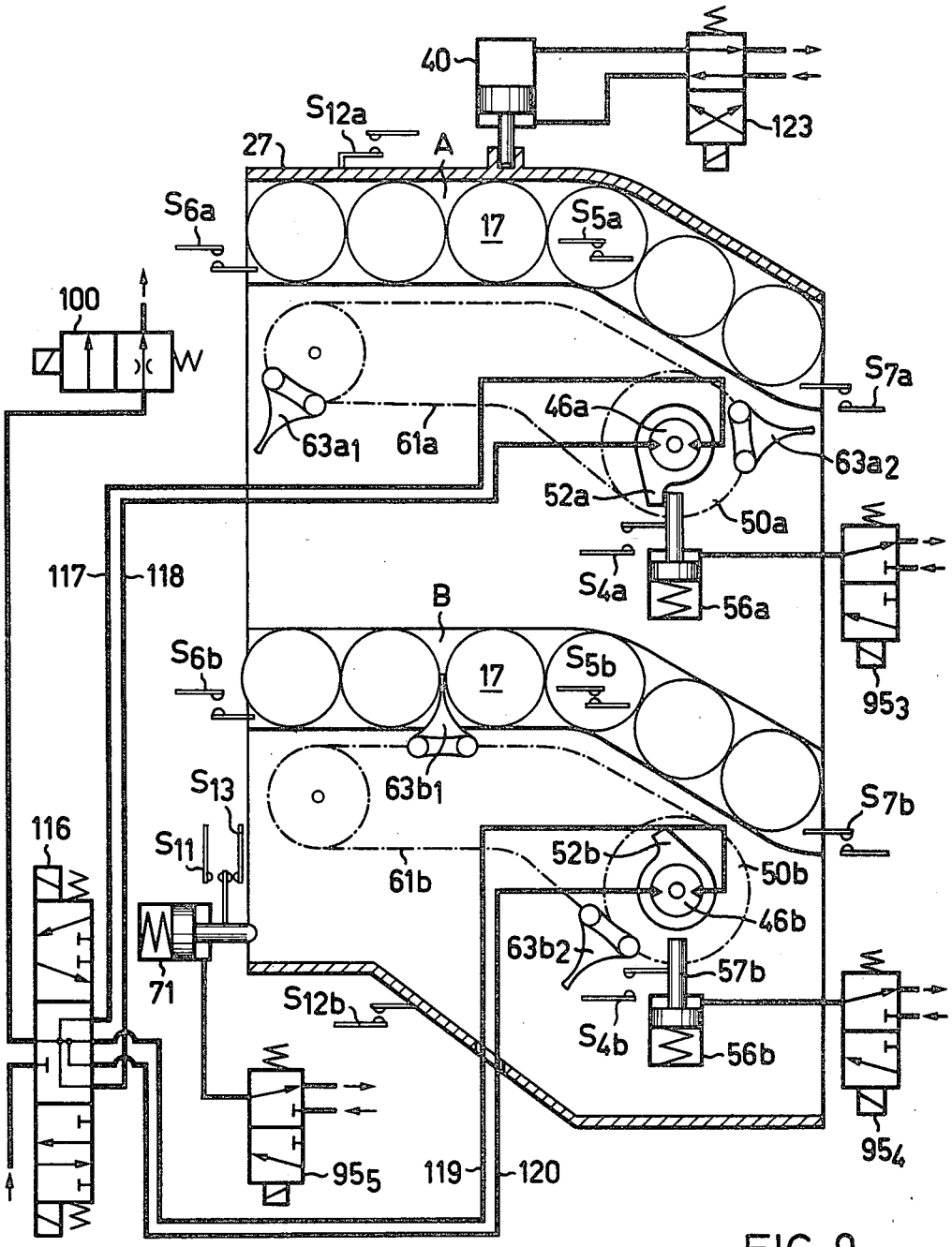
FIG. 9 is a schematic illustration of the control of the second feed device in the storage.

According to the showing of FIG. 9, both of the hydromotors 46*a* and 46*b* of the storage 27 drive the endless conveyor chains 61*a* and 61*b* by means of the sprocket wheels 50*a* and 50*b* respectively. These conveyor chains 61*a* and 61*b* each posses two respective cams $63a_1$, $63a_2$ and $63b_1$, $63b_2$. These cams or dogs $63a_1$, $63a_2$, $63b_1$, $63b_2$ serve to convey the cartridges 17, which are located in the channels A and B of the storage 27. By means of the valve 116, which can be controlled by the process computer 139, it is possible to drive the one or other hydromotor 46*a* and 46*b*, depending upon which of both channels A and B is just located in its work position. The valve 116 also renders possible simultaneous switching-off of both hydromotors 46*a* and 46*b*. The throttle valve 100 arranged in the return line 96, and which valve likewise can be controlled by the process computer 139, can throttle the speed of the hydromotors 46*a* and 46*b*.

Figure 11:
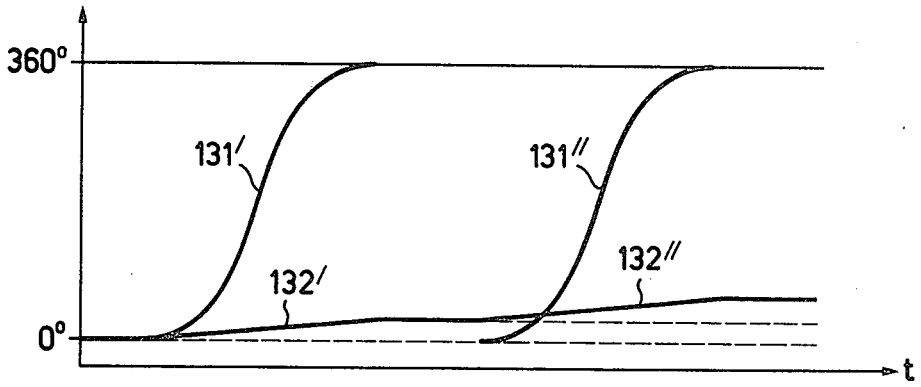
FIG. 11 is a diagram illustrating the movement of the drum.

Both of the spring-loaded hydrocylinders 56*a* and 56*b* render it possible to lock both of the conveyor chains 61*a* and 61*b* in a pre-determined position at the end of a conveying or feed operation. The hydrocylinders 56*a* and 56*b* are controlled by the reversing valve $95_3$ and $95_4$. The position of the locking bolts 57*a* and 57*b* of the locking cylinders 56*a* and 56*b* is scanned by the switches $S_{4a}$ and $S_{4b}$ and reported to the process computer 139. Equally, the position of the cams or dogs $63a_1$, $63a_2$, $63b_1$, and $63b_2$ are sensed at the end of their feed movement, i.e. when the last cartridge of the channel A has been completely pushed into the gun, by means of the switches $S_{6a}$ and $S_{6b}$, respectively, and reported to the process computer 139. Furthermore, there is also sensed the so-called waiting or preparatory position, i.e. the position of the cam $63a_2$ at the start of the relevant channel A and B shortly prior to contact with a cartridge, by means of the switches $S_{7a}$ and $S_{7b}$, respectively, and reported to the process computer 139. In this preparatory position of the cam or dog $63a_2$ the relevant chain 61*a* and 61*b* is secured against forward movement by the locking bolts 57*a* and 57*b*, respectively. By means of the switch $S_{5a}$ and $S_{5b}$ there is scanned that position of the recess 53*a* and 53*b* (FIG. 5), respectively, at the stop or impact member 52, where the stop 52, upon start-up of the locking bolt 57*a* and 57*b* respectively, no longer can collide therewith. If the locking bolts 57*a* and 57*b* have moved into their protruding or ejected position, then the conveyor chain 61*a* and 61*b*, respectively, only can be displaced to such an extent until the stop 52*a* and 52, respectively, again impacts against the locking bolts 57*a* and 57*b* respectively. As soon as the stops or impact members 52*a* and 52*b* impinge against the locking bolts 57*a* and 57*b*, respectively, then one of the cams $63a_1$, $63a_2$ or $63b_1$, $63b_2$ is located in its waiting or preparatory position. Only upon introduction of the locking bolt 57*a* or 57*b*, as the case may be, is it possible for the respective conveyor chains 61*a* and 61*b* to be further rotated. In FIGS. 3 and 9 there is illustrated the one cam $63a_2$ in its preparatory position and the other cam $63b_1$ in a random feed position. The significance of both function generators 145 and 146 will be apparent from the showing of FIG. 11. In order to be able to rotate the drum magazine or drum 9 through one chamber 26, the function generator 145 must produce a reference value 131' which corresponds to a rotation of the hydromotor through an angle of 360°, whereas the function generator 146 must produce a value 132' which is smaller by 25 times, corresponding to the transmission ratio between the synchro transmitters 131 and 132. During rotation of the drum magazine 9 through a further chamber 26 there is ensured that the first function generator 145 will again produce a signal 131'' analagous to the signal 131', whereas the function generator 146 adds a second signal 132'' to the first signal 132'. In this way there is obtained a time-optimum absolute fine positioning of the drum 9.

Figure 12:
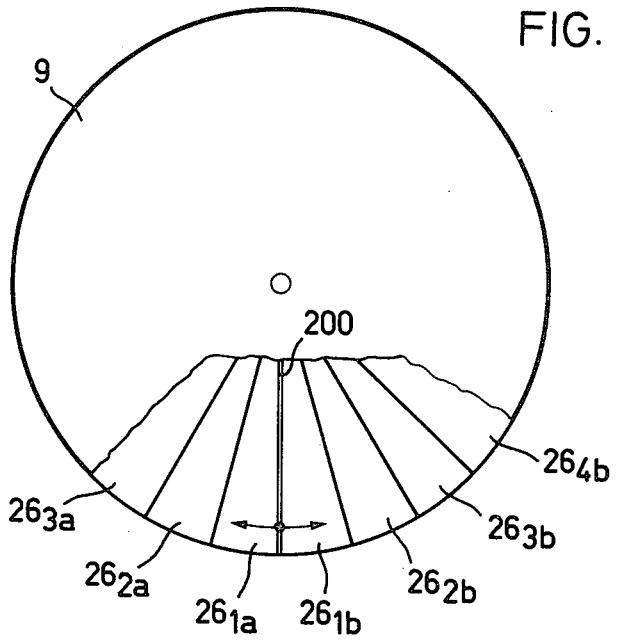
FIG. 12 is a schematic illustration of the arrangement of the cartridges or ammunition in the drum magazine or drum.

Continuing, from the showing of FIG. 12 there will be evident the arrangement of the cartridges 17 of the drum 9. Starting from a reference line 200 there are initially filled in the clockwise direction the cartridges $26_{1a}$, $26_{2a}$ etc. with ammunition of a first type A, thereafter again starting from the reference line 200 there are filled in the counterclockwise direction the chambers $26_{1b}$, $26_{2b}$, $26_{3b}$ etc. with ammunition of another type B. In accomplishing such filling operations none of the chambers should be omitted or by-passed and each chamber must be completely filled, in this case with eight cartridges. The removal of the cartridges 17 out of the drum 9 is accomplished in the reverse sequence, i.e. the chambers $26_{1a}$ and $26_{1b}$ are the last ones which are emptied.

The mode of operation of the described cartridge feed system is as follows:

(1) The loading of the drum magazine or drum 9 is accomplished through the opening 12*a* and the cover 12. The chamber 26 which is to be loaded is rocked into the region of the opening 12*a*. Thereafter the arm 20, according to the showing of FIG. 1, is rocked in the clockwise direction out of the region of the filling opening, where previously there has been pivoted away the blocking lever 22. As soon as the arm 20 has been rocked out of the region of the filling or infeed opening, then eight cartridges can be inserted through the opening 12*a* of the cover 12 into the chamber 26. Thereafter, the arm 20 is rocked back into its starting position (FIG. 1) and locked or blocked by the lever 22. In this manner all of the chambers 26 of the drum or drum magazine 9 can be rocked to the region of the opening 12*a* of the cover 12 and filled each with eight cartridges 17 in the aforedescribed manner. As will be apparent from the showing of FIG. 1, the first cartridge 17 of each chamber 26 is located in the related throughpass opening 26*a* of the plate 25 and bears against the rails 35 or 37, 38, 39. The drum 9 can be filled with two different types of ammunition or cartridges, in that, starting from the reference line 200, there is filled for instance a number of chambers 26 in the clockwise direction with a first ammunition type A and, again starting from the reference line 200, the remaining chambers 26 are filled in the counterclockwise direction with another ammunition type B. Both of the channels A and B of the storage 27 must be likewise filled with cartridges. Filling of these channels A and B can be accomplished for instance, with the aid of the feed device which displaces the cartridges 17 out of the chambers 26 of the drum 9. Only when both of the channels A and B are completely filled with cartridges, and when cartridges 17 are present in the feed system 5 of the weapon and the drum 9 has the chambers 26 thereof correctly filled with the cartridges, is there completely established the firing readiness of the automatic gun or weapon.

During series or rapid firing, the described cartridge feed system functions as follows:

(2) Initially the gunner must select the desired ammunition type A or B. By virtue of this selection, the storage 27 is appropriately pivoted or rocked, so that the channel which contains the desired type of ammunition arrives at the region of the ammunition feed (FIG. 3). At the same time the sector feeder is rotated rearwardly until the pawl 83*a* blocks (FIG. 8). Then the drum 9 is rotated such an extent until the correct chamber having the desired type of ammunition arrives at the feed position and is then locked in such position. Thereafter, the sector feeder is rotated forwardly. In this condition the row of cartridges in the channel A or B, as the case may be, and the feed sector 26 are tightly pressed against the weapon or gun; the sector feeder contributes to this action and the channel feeder only if a cam 63 is located in the channel. As long as firing is not accomplished the drives of the channel- and sector feeders are under hydraulic pressure, but cannot rotate.

As soon as the gunner triggers a rapid or series firing operation, then the sector feeder can rotate and possibly also the channel feeder, since now at the side of the weapon cartridges are continuously removed from the channel and the drum. The ammunition or cartridges are ejected out of the chamber 26 of the drum 9 in rhythm with the firing cadence of the automatic gun. As soon as the entrainment member 18 has reached its end or terminal position, i.e. when the chamber 26 is empty, then the switch $S_o$ is closed (FIG. 8). Closing of this switch $S_o$ is reported by the process computer 139. This process computer 139 now delivers two signals, namely a first signal which causes unlocking of the channel feeder and a second signal which brings about a rearward rotation of the sector feeder, as will be apparent from the flow diagram of FIG. 10. Both of these signals arrive at the control valves 95 and 99. The channel feeder 46*b* is now no longer locked and can rotate. The cam $63b_2$ of the channel feeder, which in the meantime was located in the preparatory or waiting position, impacts against the last cartridge 17 which was ejected by the entrainment member 18 of the sector feeder into the channel and thus further conveys all of the cartridges located in the channel into the gun, so that there is no interruption in the cartridge feed. The position, where the nose 52*b* has arrived behind the locking or blocking bolt 57*b*, is sensed or scanned by the switch $S_{5b}$ and reported to the process computer 139. This process computer 139 delivers a signal to the reversing valve 95, so that the locking or blocking bolt 57*b* is again brought into its locking or blocking position by the hydrocylinder 56*b*. In the meantime the sector feeder has been rotated back until the pawl 83*a* (FIG. 8) has again arrived at its blocking position. This position of the sector feeder is reported by the switch $S_1$ to the process computer 139. As soon as this signal of the switch $S_1$ has been delivered, then the drum locking mechanism is released in that the reversing valve $95_1$ receives a signal and actuates the hydrocylinder 74 (FIGS. 7 and 10). This unlocking action is detected by the switch $S_2$ and reported to the process computer 139. Following this signal is a command for rotation of the drum 9 through one chamber 26. The function generator 145 or 146 (FIG. 7) ensures for the function required for this purpose and transmits such function in the form of a reference value to the control transformer 142 and 143 respectively. After the reference position has been approximately reached, then a locking command is given to the process computer 139. The reversing valve $95_1$ is actuated and the drum 9 is again locked by the hydrocylinder 74 (FIG. 10). The locking action is detected by the switch $S_3$ and reported to the process computer 139. This signal triggers a command causing the sector feeder to again rotate in the feed direction, in that the reversing valve 99 is activated and switches the hydromotor 82. During the further indexing of the drum 9 by an amount corresponding to one chamber 26, i.e. from the rotation back of the sector feeder until the renewed drive in the feed or conveying direction, the feed of the cartridges to the weapon is solely brought about by the channel feeder. Since in this time span the gun fires further, there have formed in the storage channel A or B, respectively, as the case may be, behind the cam or dog $63b_2$ a hollow space amounting to a number of cartridges 17. This hollow space must now be filled again by the sector feeder and specifically in such a manner that the gap is just then completely filled when the channel feeder has terminated its function, i.e. when the cam $63b_2$ has inserted the last cartridge 17 into the gun or firing weapon 4. The so-to-speak overtake speed of the sector feeder is only slightly greater than the feed speed corresponding to the firing cadence of the gun. In this way there is achieved the result that the gap between the cartridges is not closed due to impact of two cartridges. As soon as the cam $63b_2$ departs out of the storage channel, there are thus displaced into the storage channel by the sector feeder six of the eight cartridges located in the chamber 26. The remaining two cartridges are still located in such chamber 26. Now the sector feeder is solely responsible for the further feed of the cartridges 17, and the channel feeder is no longer active. The feeding of the cartridges solely by the sector feeder is now accomplished for the aforementioned two cartridges. The cam $63b_1$ of the channel feeder therefore should again immediately return into the waiting or preparatory position in order to take over the function of the sector feeder.

The departure of the cam $63b_2$ out of the channel is reported by the switch $S_{6b}$ to the process computer 139 (FIG. 9). Consequently, the throttle valve 100 is switched, so that the feed speed is slowed down and the nose or nose member 52*b* does not impact too hard against the locking or blocking bolt 57*b*. This impact is reported by the switch $S_{7b}$ to the process computer 139 with the result that the throttle valve 100 is again switched or reversed, in order that the channel feeder again can feed at the full speed. In the meantime the entrainment member 18 of the sector feeder almost has reached its end or terminal position. In this end or terminal position of the entrainment member 18 the switch $S_o$ is actuated and the process computer 139 receives a signal, with the result that the described operation repeats.

While there are shown and described present preferred embodiments of the invention, it is to be distinctly understood that the invention is not limited thereto, but may be otherwise variously embodied and practiced within the scope of the following claims.

Accordingly, what we claim is:

1. A cartridge feed system for an automatic gun, comprising:

a gun mount;

a drum, including a drum shaft secured to said gun mount;

means for rotatably mounting said drum about said drum shaft;

means for indexably driving said drum;

said drum being provided with means for forming a number of chambers therein, each chamber being capable of receiving cartridges to be fired by the gun;

a first feed device for moving cartridges out of each chamber of the drum;

said first feed device being stationarily arranged externally of the drum;

a storage arranged between said drum and said gun;

said storage being provided with two channels;

means for displaceably mounting said storage together with said channels;

each channel being selectively displaceable into a work position and into a rest position for the selective firing of different types of cartridges;

and a second feed device for moving the cartridges out of the storage and delivering such cartridges to the gun while the drum is further rotated through one indexing step.

2. The cartridge feed system as defined in claim 1, wherein:

said mounting means for said storage mounts said storage to be pivotable into two positions;

both of said channels being located in the pivotably mounted storage;

a first one of the channels being located in its work position when the storage assumes one of its pivotable positions and the second channel being located in its work position when the storage assumes the other of its other pivotable positions.

3. The cartridge feed system as defined in claim 1, wherein:

the first feed device for each chamber of the drum comprises a displaceable carriage;

an entrainment arm pivotably mounted upon the said displaceable carriage and serving for the displacement of the cartridges;

said first feed device further comprising a conveyor chain mounted upon sprocket wheels;

stop means for displacing said carriage of the chamber of the drum located in its work position; and said conveyor chain being disposed externally of the drum.

4. The cartridge feed system as defined in claim 2, wherein:

said second feed device is arranged in said storage and possesses a respective endless conveyor chain for each channel;

said second feed device further including entrainment teeth means for displacing the cartridges located in a related channel; and a separate drive provided for each conveyor chain.

5. The cartridge feed system as defined in claim 1, wherein:

said drive means for the drum comprises a first hydromotor for driving said drum;

drum conveyor chain means;

a second hydromotor for driving the drum conveyor chain means;

a first storage-conveyor chain;

a third hydromotor for the drive of the first storage-conveyor chain;

a second storage-conveyor chain;

a fourth hydromotor for the drive of the second storage-conveyor chain;

a first hydrocylinder for the drive of the storage;

a second hydrocylinder for locking the drum;

a third hydrocylinder for locking the drum-conveyor chain means;

a respective fourth and five hydrocylinder for the locking of the storage-conveyor chains; and a sixth hydrocylinder for locking the storage.

* * * * *